US006085568A

United States Patent [19]

Meyer

[11] Patent Number: 6,085,568

[45] Date of Patent: Jul. 11, 2000

[54] ADJUSTABLE FORCE DEFLECTION DEVICE FOR VEHICLE WORK BENCHES

[76] Inventor: Herbert Meyer, Russlandweg 86, D-26446 Friedeburg, Germany

[21] Appl. No.: 09/043,617

[22] PCT Filed: Sep. 20, 1996

[86] PCT No.: PCT/EP96/04170

§ 371 Date: Oct. 5, 1998

§ 102(e) Date: Oct. 5, 1998

[87] PCT Pub. No.: WO97/10906

PCT Pub. Date: Mar. 27, 1997

[30] Foreign Application Priority Data

Sep. 23, 1995 [DE] Germany ..... 195 35 461

[51] Int. Cl.[7] ..... B21J 13/08

[52] U.S. Cl. ..... 72/295; 72/305; 72/708

[58] Field of Search ..... 72/295, 305, 293, 72/705

[56] References Cited

U.S. PATENT DOCUMENTS

| | | | |
|---|---|---|---|
| 2,245,806 | 6/1941 | Oeckl et al. | 72/481.7 |
| 2,668,727 | 2/1954 | Zinke . | |
| 3,385,093 | 5/1968 | Menser | 72/705 |
| 4,959,991 | 10/1990 | Andersson | 72/705 |
| 5,916,322 | 6/1999 | Venalainen | 72/705 |

FOREIGN PATENT DOCUMENTS

| | | |
|---|---|---|
| 0501330 A1 | 2/1992 | European Pat. Off. . |
| 2831627 | 2/1979 | Germany . |
| 8610367 | 7/1986 | Germany . |
| 9306709 | 12/1993 | Germany . |
| 1140744 | 1/1969 | United Kingdom . |
| 1267521 | 3/1972 | United Kingdom . |

*Primary Examiner*—David B. Jones
*Attorney, Agent, or Firm*—Skjerven, Morrill, MacPherson, Franklin & Friel, LLP; William L. Robinson

[57] ABSTRACT

The invention is an adjustable force deflection device which can be used to guide, deflect, and apply force used in the restoration of deformed vehicle bodies on work benches or straighteners. The device consists of at least two fixable, pivoted joints, each comprising a pair of coupling discs that can be independently rotated about a common central axis to a desired angle relative to each other and then fixed in place. One of the coupling discs in each of the at least two pivotable joints is connected to either a separate force application device or to a tool attached to the portion of the vehicle body to be restored. The second of the coupling discs in each pair is connected to at least one rigid, elongated element of various possible sizes and shapes, or to a plurality of such rigid, elongated elements and interconnecting pivotable joints connected in alternating series. The pivotable joints and interconnecting rigid elements can be arranged in combinations of angles between each other so as to direct the restoring force around an intervening obstacle, to precisely direct the force to be applied to the vehicle body, or to transform an applied pulling force into a pushing force and vice versa.

13 Claims, 3 Drawing Sheets

ADJUSTABLE FORCE DEFLECTION DEVICE FOR VEHICLE WORK BENCHES

1. Field of the Invention

The invention relates to an adjustable force deflection device for motor vehicle body straighteners used for repairing deformed vehicle bodies, using a hydraulically movable pull beam, pull tower or similar force applying mechanism, which is pivoted to the straightening frame, for fastening to the pulling elements, such as chains, hooks, clamps, or similar tools, which are to be attached to the places to be restored.

2. Description of the Related Art

A great many pulling tools for restoring deformed vehicle bodies are known, which tools are attached at one end to so-called pull beams, pull towers or the like, for example by means of chains, and which are capable at a second end of engaging plate edges, door posts, shock absorber supports and the like to exert a pulling force on them.

A major drawback of these conventional devices is the fact that the hold-down elements used for straightening and forming, which extend from the pull beam, are all designed to exert only pulling forces. This requires a rectilinear direction of pull at all times, which cannot in all cases lead to the point on the vehicle that is to be restored. In practice it is usual, therefore, to deflect the line of pull of the chain that is typically used from the pull beam to the point of attachment on the vehicle body, using additional hydraulic pulling means, to effect a different direction of pull with respect to the point of attachment, which is a laborious activity. This requires the use of additional complicated tools and additional operations for attaching and supporting additional hydraulic devices. These devices can only be used to a limited degree and only in a few cases, however, since it is necessary to find a strong support, which is capable of taking up the force to be deflected, if said force cannot be exerted directly from the straightening machine at the required place of attachment on the vehicle body. In addition, there is a danger that the known method of deflecting forces will lead to deformation of body parts that were previously undeformed. A double deflection, for example according to a line of pull that extends partially in a horizontal plane and partially in a vertical plane, or at an angle therebetween, may be theoretically possible with the known deflection systems, but in practice, however, it is impracticable.

Another major drawback of known straightening machines is the fact that they require a large amount of space circumferentially for the straightening operations, in view of the large pivoting area of the pull beam. Since it must be possible to exert the required pulling force in all directions via the pulling elements attached to the vehicle body, a large working area is required for carrying out all straightening operations.

In spite of the many variations that are possible, the known devices cannot be used effectively at all places on the vehicle body, for example in the trunk, the engine compartment, in the area of the wheel housings and of other internal constructional elements, such as the universal joint and drive gear tunnels, which extend at a great many different angles, because accessibility is limited at those locations.

Consequently it is an object of the present invention to provide a force deflection device for motor vehicle body straighteners used for repairing deformed vehicle bodies, using a known hydraulically moved pull beam or pull tower, which is pivoted to the straightening frame, which is intended for use in the known devices of the kind referred to in the introduction, and by means of which the above-described drawbacks can be overcome.

It is another object of the invention to simplify and improve the use of sets of straightening elements for arranging and setting up the vehicle bodies on the straightening machine, and also to increase the operating range of the sets of straightening elements while using few elements.

BRIEF SUMMARY OF THE INVENTION

These and other objects are accomplished by a force deflection device for motor vehicle straighteners comprising two or more fixable pivoted joints, each including a pair of rotatable coupling discs that can be fixed in rotational position with respect to each other, and at least one rigid, elongated element connected between each pair of coupling discs.

A force deflection device comprising these features makes it possible to exert forces around the linkages, posts and other vehicular constructional obstacles in all planes, without using additional auxiliary attachments, or the like, and also makes it possible to exert not only pulling forces, but also pushing forces, without a conversion being required, so that the amount of space required for one-directional operation may be reduced in many cases.

BRIEF DESCRIPTION OF THE DRAWINGS

The invention will be explained in more detail in the following detailed description of the embodiments, wherein reference is made to the drawings, in which.

DETAILED DESCRIPTION OF THE INVENTION

Figure 1:
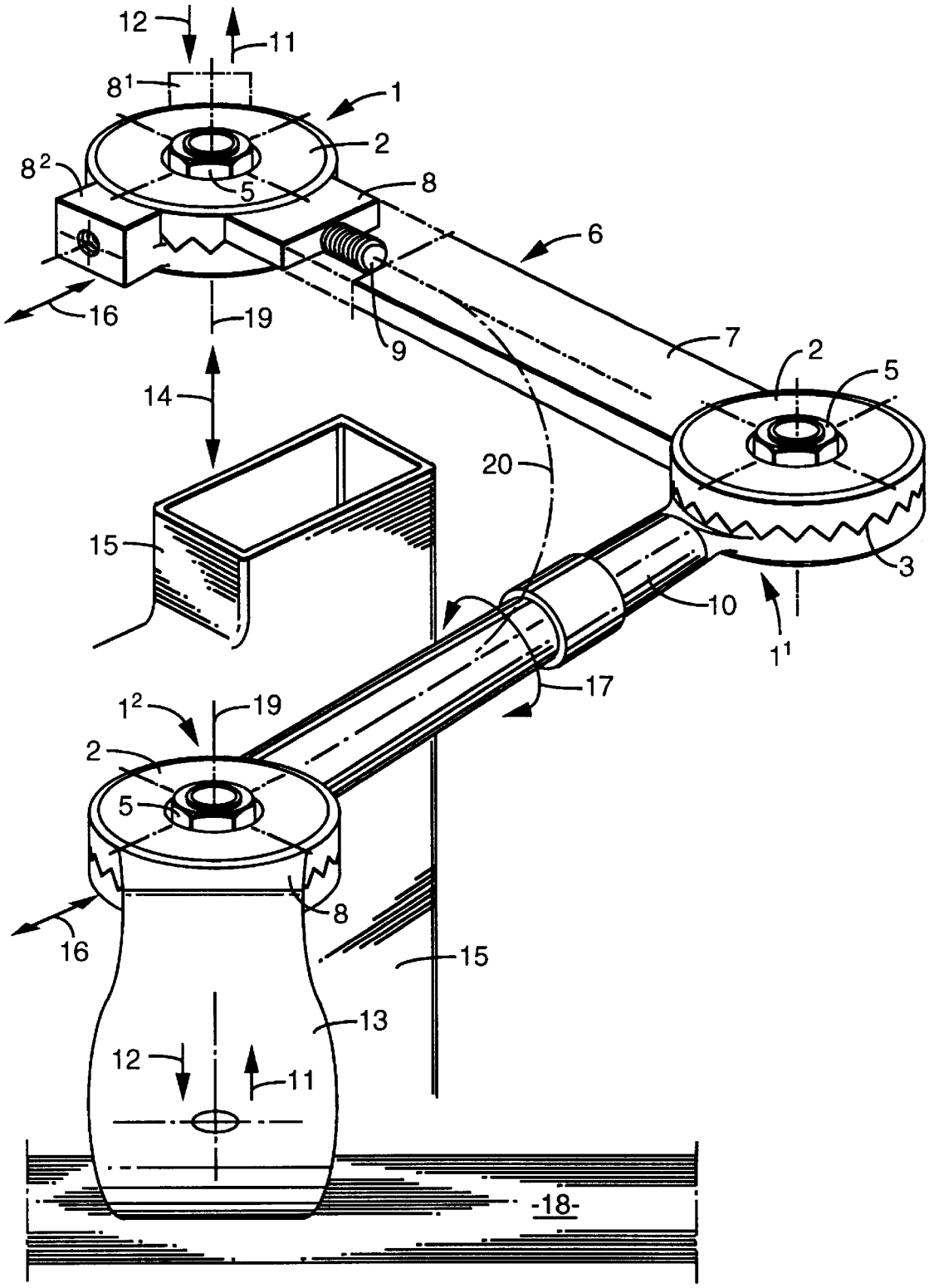
FIG. 1 is a perspective view of the force deflection device extending from a pull beam to a vehicle body portion.

FIG. 1 is a perspective view of one embodiment of the adjustable force deflection device of the present inventions, which includes at least two adjustable pivoted joints 1, each comprisingtwo coupling discs 2 provided with spur teeth 3. The mating contact surfaces 4 of the coupling discs 2 are pressed together by means of a central bolt connection 5, thus locking the coupling discs 2 against rotation relative to each other and connecting them tightly together for transmitting large forces.

Coupling discs 2: are connected to elongated elements 6 of a type which can be freely selected. Said connection may be a rigid connection or take place via connecting pieces 8, for example comprising a welded-on flat steel section 7 having a rectangular cross section, or for example a solid round steel rod section or a tubular section 10. The interconnected elongated elements 6, which are connected to a hydraulically adjustable pull beam (not shown), for example via a connecting piece $\mathbf{8}^1$, transmit the pulling forces via the rigidly fixed pivoted joints 1, $\mathbf{1}^1$, $\mathbf{1}^2$ in the direction of arrow 11 to the body portion 18 which is set up in a pull clamp 13, although parts 15 of the vehicle body are present in the straight line 14 in which the pulling force and the pushing force are to be exerted.

It is also possible, however, to exert a pushing force in an advantageous manner from the pull beam, in the direction indicated by arrow 12, on pull clamp 13 or on another desired tool so as to straighten the body.

A particularly advantageous effect can be achieved with the force deflection device according to the invention in that it is possible, without effecting any conversion, not only to exert a pulling force or a pushing force on the body to be straightened, but also to convert a pulling force exerted by the pull beam into a pushing force by means of the force deflection device according to the invention.

For example, with an identical arrangement of the pivoted joints 1, $\mathbf{1}^1$, $\mathbf{1}^2$ a pushing force in a direction indicated by arrow 16 is transmitted in parallel fashion through 180°°, via connecting piece $\mathbf{8}^2$ of pivoted joint 1, to a selected tool on pivoted joint $\mathbf{1}^2$ as a pulling force in the same direction of arrow 16. Or, conversely, a pulling force on connecting piece $\mathbf{8}^2$ of pivoted joint 1 is converted in a corresponding manner into a pushing force on pivoted joint $\mathbf{1}^2$ via connecting piece 8. Difficult paths for transmitting forces can be controlled in a relatively simple manner with the force deflection device according to the invention, the more so if an elongated element 6, for example in the shape of a round section 10, is additionally designed to be capable of radial pivoting movement in the direction indicated by arrow 17. In such a case, the force deflection device can accomodate almost any position of the tools at either of its ends.

In another advantageous embodiment, the one-piece elongated element 6 may also be curved, or extend along arcuate line 20, in order to achieve complicated deflections while using few pivoted joints 1.

Figure 2:
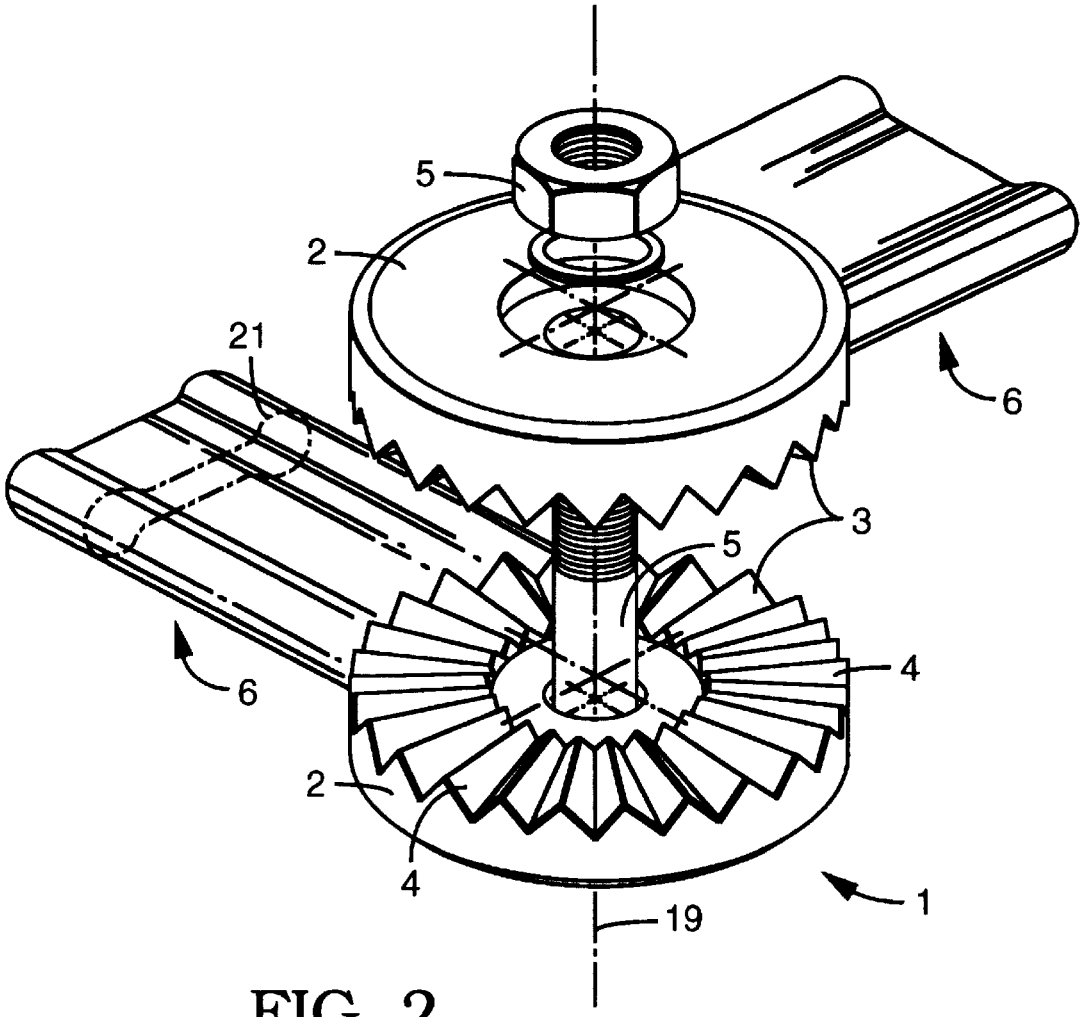
FIG. 2 shows an open spur teeth joint.

FIG. 2 shows the fixable pivoted joint 1 in an open condition. The large contact surfaces of the tooth flanks 4 of the spur teeth 3 on the coupling discs 2 diverge outwardly from central axis 19. This special construction of the coupling discs 2 provides a tolerance-free, force-retaining transmission, and it allows no radial displacement at all when large forces are being transmitted. This is an important condition for an effective deflection of forces when straightening deformed vehicle bodies. Trouble-free straightening is ensured by the coupling discs 2 in combination with, for example, stable, torsionally stiff, welded-on elongated elements 6. A specially designed section 21 having a cross-section (21) in the shape of a dumbbell and comprising round, claviform flange portions has proved to be a particularly advantageous elongated element 6, which exhibits great buckling and bending stiffness, for deflecting large forces.

Figure 3:
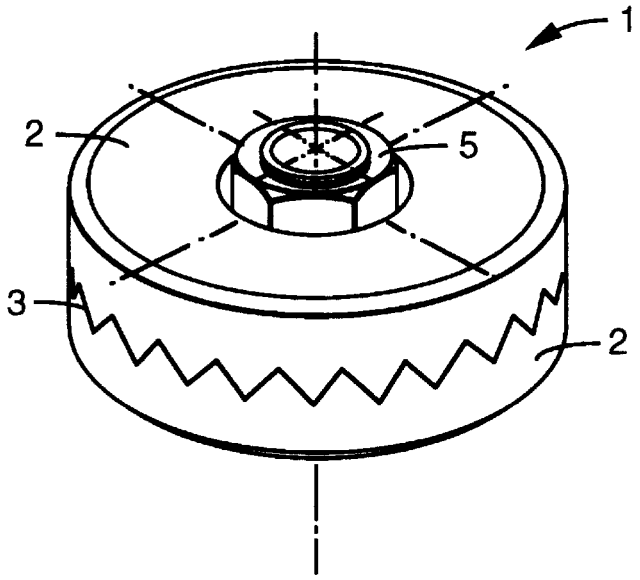
FIG. 3 shows a closed spur teeth joint according to FIGS. 1 and 2.

In FIG. 3 the coupling discs 2 are shown screwed tightly together with their mating spur teeth locked in coaxial engagement by means of central bolt connection 5, thus forming a rigid unit, to which sturdy connections are possible in an advantageous manner at selected locations on the rail sides and on the end faces.

Figure 4:
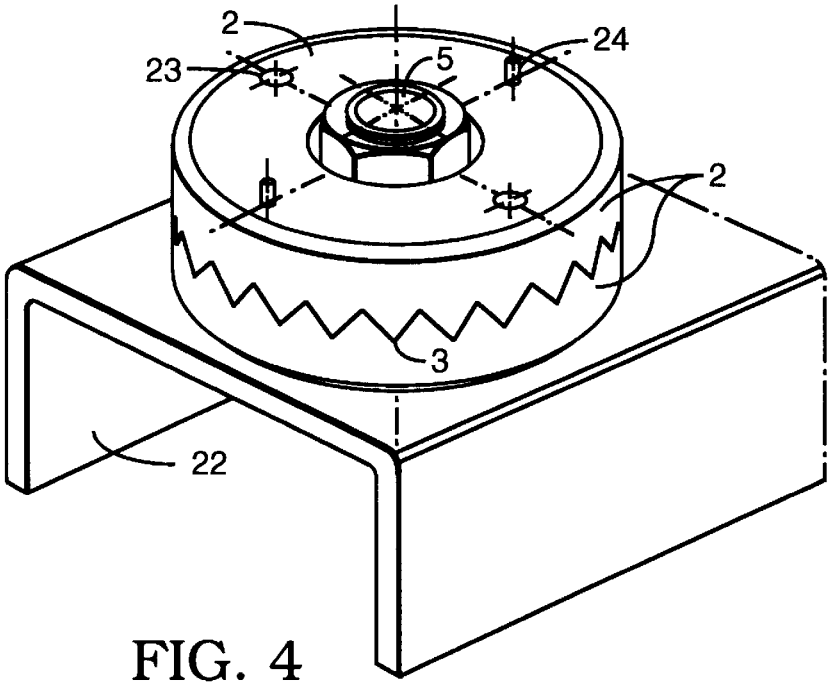
FIG. 4 shows a surface joint according to FIG. 3.

FIG. 4 shows such a connection on the end face to a U-section, for example on a typical rail 22 of a straightening machine. The fixation of the connection may take place by means of the central bold connection 5 and/or via additional bolt connections, for example in the shape of threaded bores 23 in the end faces of coupling discs 2, with the optional provision of locking pins 24 to ensure a precise radial adjustment, if this should be required. Such connecting possibilities, which are also possible on the end faces, enable a solid attachment of pivoted joint 1 to all conceivable structural members of the straightening machine, for example to the rails of the straightening machine, pull beams of the straightening machine, and also to the most important conventional pulling tools.

Figure 5:
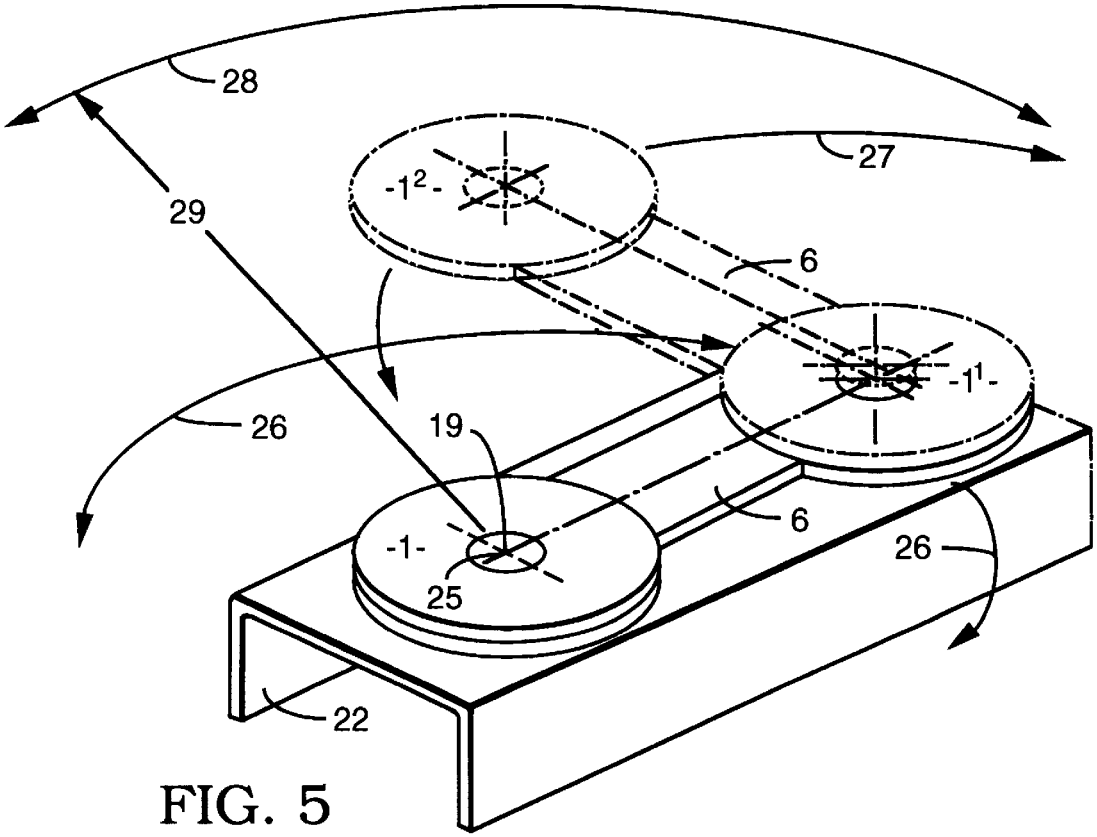
FIG. 5 is a diagrammatic example of a receiving element for a straightening element according to FIG. 4.

Another use of the fixable pivoted joint 1 is shown in FIG. 5, which diagrammatically illustrates an advantageous use for sets of straightening elements on straightener rails 22. Pivoted joint 1 is screwed on a straightener rail 22 with an end face connection, in a similar manner as that shown in FIG. 4. This enables the pivoted joint $\mathbf{1}^1$ to be adjusted throught a large number of angular positions around a first pivoting circle 26. The pivoted joint $\mathbf{1}^2$ connected thereto can also be adjusted through a large number of angular positions around a second pivoting circle 27 in a similar manner. This makes it possible, for example in order to accommodate straightening sets, to accurately determine and fix the pivoted joint $\mathbf{1}^2$ in the entire plane from the centre 25 of central axis 19 over a radius 29 up to large circle 28. Such an arrangement makes it possible—starting from one specific dimension of the straightening machine—to accommodate, arrange, set up and straighten vehicle bodies varying in size from small to large in accordance with vehicle body contour templates.

LIST OF REFERENCE NUMERALS

1. fixable pivoted joint
2. coupling discs
3. spur teeth
4. tooth flanges
5. screw connection
6. elongated element
7. section
8. connecting piece
9. screw connection
10. round section, tubular section
11. direction of arrow, pull
12. direction of arrow, pressure
13. pull clamp
14. line of pull, line of pressure
15. vehicle body
16. direction of arrow
17. direction of arrow
18. body portion
19. central axis
20. arch line
21. sectional view of section
22. straightener rail
23. threaded bore
24. locking pin
25. centre
26. first pivoting circle
27. second pivoting circle
28. largest circle
29. radius

What is claimed is:

1. An adjustable force deflection device for use with a motor vehicle body straightener of the type that includes a frame and a mechanism attached to the frame for exerting a pushing or a pulling force on a tool attached to the vehicle body, connecting the force exerting mechanism to the attached tool and for enabling the force exerting mechanism to exert a pushing or a pulling force on the attached tool, said adjustable force deflection device characterized by:

at least two fixable pivoted joints (1), each comprising a pair of coupling discs (2) disposed in compressive coaxial engagement with each other along a central axis for indepenent rotation about said axis, said discs being compressibly fixable to each other against relative rotation thereon, a first one of said coupling discs (2) in each of said at least two pivoted joints (1) being connected to a respective one of said force exerting mechanism and said pulling tool; and, at least one rigid, elongated element (6, 7, 10) having opposite ends respectively connected to a second one of said pair of coupling discs (2) in each of said at least two pivoted joints (1), whereby, a force exerted by said force exerting mechanism is transmitted through said at least two pivoted joints (1) and said at least one rigid, elongated element (6, 7, 10) to said pulling tool attached to said vehicle.

2. An adjustable force deflection device according to claim 1, wherein said at least one rigid, elongated element is shaped to extend around an obstacle positioned between said opposite ends.

3. An adjustable force deflection device according to claim 1, wherein said at least one rigid, elongated element comprises at least one additional one of said fixable pivoted joints and at least two of said rigid, elongated elements, wherein one end of each of said at least two rigid, elongated elements is respectively connected to the second one of said pair of coupling discs of the first said pair of fixable pivoted joints and the respective opposite end of said at least two rigid, elongated elements is connected to a respective one of said coupling discs of said at least one additional fixable pivoted joint.

4. An adjustable force deflection device according to claim 1, wherein each said fixable pivoted joint (1) is further characterized by at least one adjustable compression fastener (5) extending axially through said pair of coupling discs (2) for adjusting the force of said compressive coaxial engagement between said discs.

5. An adjustable force deflection device according to claim 1, wherein the mating surfaces of the coupling discs (2) to be connected together incorporate locking means for preventing relative rotation between said discs.

6. An adjustable force deflection device according to claim 5, wherein said mating surfaces of said coupling discs (2) incorporate mating teeth on said disc surfaces which engage each other to prevent relative rotational movement thereof.

7. An adjustable force deflection device according to claim 6, wherein said mating teeth are spur teeth (3), comprising tooth flanks (4) which diverge outwardly towards the radial outer circumference of the coupling disc.

8. An adjustable force deflection device according to claim 1, wherein said coupling discs (2) of the fixable pivoted joint (1) are rigidly connected to the ends of said at least one elongated element (6, 7, 10).

9. An adjustable force deflection device according to claim 1, wherein said coupling discs (2) of the pivoted joint (1) are detachably connected to the ends of said at least one elongated element (6, 7, 10).

10. An adjustable force deflection device according to claim 1, wherein said at least one elongated element (6, 7, 10) is rectilinear in cross section between its ends.

11. An adjustable force deflection device according to claim 1, wherein an intermediate portion of said at least one rigid, elongated element (6, 7, 10) is curved between its ends.

12. An adjustable force deflection device according to claim 1, wherein said at least one rigid, elongated element has a cross-section between its ends characterized by a solid round, a tubular, or a hollow dumbbell shape.

13. An adjustable force deflection device according to claim 1, wherein at least one of said coupling discs in said at least two flixable pivoted joints is fitted with a pulling tool comprising a clamp, an eye, a hook, or a chain.

* * * * *